US007263795B1

(12) United States Patent
Curry

(10) Patent No.: US 7,263,795 B1
(45) Date of Patent: Sep. 4, 2007

(54) EXTRACTOR FOR A REVOLVER

(75) Inventor: Brett Curry, Chicopee, MA (US)

(73) Assignee: Smith & Wesson Corp., Springfield, MA (US)

( * ) Notice: Subject to any disclaimer, the term of this patent is extended or adjusted under 35 U.S.C. 154(b) by 177 days.

(21) Appl. No.: 10/774,666

(22) Filed: Feb. 9, 2004

Related U.S. Application Data

(60) Provisional application No. 60/446,869, filed on Feb. 12, 2003, provisional application No. 60/446,654, filed on Feb. 11, 2003.

(51) Int. Cl.
*F41A 15/00* (2006.01)

(52) U.S. Cl. ..... 42/68; 42/64

(58) Field of Classification Search ..... 42/68, 42/64

See application file for complete search history.

(56) References Cited

U.S. PATENT DOCUMENTS 116,078 A * 6/1871 Moss et al. ..... 42/68
4,543,741 A * 10/1985 Phillips, Jr. ..... 42/68
4,934,081 A 6/1990 Mooney
4,934,082 A * 6/1990 Laendler ..... 42/68
5,218,148 A * 6/1993 Mochak ..... 42/68

* cited by examiner

*Primary Examiner*—Michael J. Carone
*Assistant Examiner*—Gabriel J. Klein
(74) *Attorney, Agent, or Firm*—McCormick, Paulding & Huber LLP

(57) ABSTRACT

An extractor for the removal of cartridges from the cylinder bores of a revolver. The extractor includes an extractor plate having a plurality of arms extending radially outward from an inner portion of the plate. The arms form an inner surface between adjacent arms. The inner surface substantially conforms to the profile of a bore of the cylinder and has an arc length that is greater than one-half the circumference of a cartridge disposed within the cylinder bores of the revolver. The inner surface contacts the rim of a cartridge and facilitates the removal of the cartridge from the bore. The inner surface may also include a beveled edge and the arms may have convex or concave end portions. The extractor also includes a tubular stem mounted to the inner portion of the extractor plate.

16 Claims, 5 Drawing Sheets

EXTRACTOR FOR A REVOLVER

CROSS REFERENCE TO RELATED APPLICATIONS

This application claims the benefit of U.S. Provisional Patent Application Ser. No. 60/446,654, filed on Feb. 11, 2003, entitled "RIMFIRE EXTRACTOR FOR A REVOLVER" and U.S. Provisional Patent Application Ser. No. 60/446,869, filed on Feb. 12, 2003, entitled "EXTRACTOR SURFACE PROFILE CONTOUR REVOLVER," both herein incorporated by reference in their entireties.

FIELD OF THE INVENTION

The present invention relates to firearms generally and more specifically to extractors used for removal of empty cartridges from the cartridge chambers of a revolver cylinder.

BACKGROUND OF THE INVENTION

Extractors used for removal of spent cartridge cases from the cartridge chambers of a revolver cylinder, referred to herein as "cylinder bores" or "bores," are generally in the form of an extractor plate mounted adjacent one end of a tubular stem. The extractor plate typically has a plurality of radially extending arms equally spaced apart and defining, between each adjacent pair of arms, a cylindrical, concave, radiused surface that conforms to the shape of a bore of the cylinder. The radiused surfaces are adapted to fit under and engage the rims of cartridge cases disposed in the cylinder bores.

Prior art extractor plates fit within a recess in the rear surface of the revolver cylinder. The recess typically has a depth that is approximately equal to the thickness of the extractor plate. As the extractor plate fits within the recess in the cylinder, the concave, radiused surfaces of the plate form part of the bores in which the cartridges are disposed. Typically, the recess also includes edge portions adapted to conform to the shape of the outer perimeter of the extractor plate. In prior art extractor designs, such as in U.S. Pat. No. 5,218,148, herein incorporated by reference in its entirety, the ends of the extractor arms that define the outer perimeter of the extractor plate fit in a contiguous parallel relationship with the upright edges which define the perimeter of the recess. This contiguous parallel relationship limits the rotation of the extractor plate.

Although prior art extractors have proven extremely reliable, it is possible that prior art designs may provide insufficient contact between the extractor and the rim of the cartridge case creating the possibility of an angular misalignment of the extractor with the cartridge. Additionally, prior art extractors may have difficulty extracting rim fire cartridges as such cartridges are thin walled and have the tendency to expand against the cylinder bores under the pressures generated during firing. Such expansion could potentially make extraction difficult as the prior art extractor plates form part of the cylinder bores.

In light of the above, an object of the present invention is to provide an improved extractor for revolvers by increasing the contact area between the extractor and the cartridge.

An additional object of the present invention is to provide an improved extractor for rim fire ammunition. This object is accomplished by providing an extractor that does not form part of the cylinder bores and engages only the rim of the cartridge. The bores are entirely disposed within the cylinder thereby allowing the rim fire case to expand outwardly upon firing without affecting the extractor.

This and other objects and advantages of this invention will be more readily appreciated from a reading of the application in conjunction with the drawings annexed hereto as follows.

SUMMARY OF THE INVENTION

An embodiment of the present invention is an extractor for the removal of cartridges from the cylinder of a revolver. The extractor includes an extractor plate having a plurality of arms extending radially outward from an inner portion of the plate. The arms form an inner surface between adjacent arms. The inner surface substantially conforms to the profile of a bore of the cylinder and has an arc length that is greater than one-half the circumference of the bore. The inner surface contacts the rim of a cartridge and facilitates the removal of the cartridge from the bore. The extractor further includes a tubular stem having an end that is mounted to the inner portion of the extractor plate.

DETAILED DESCRIPTION OF THE PREFERRED EMBODIMENT

An exemplary cylinder assembly in which the present invention may be practiced is shown in U.S. Pat. No. 5,218,148 incorporated herein by reference in its entirety. The cylinder assembly is described in detail below.

Figure 1:
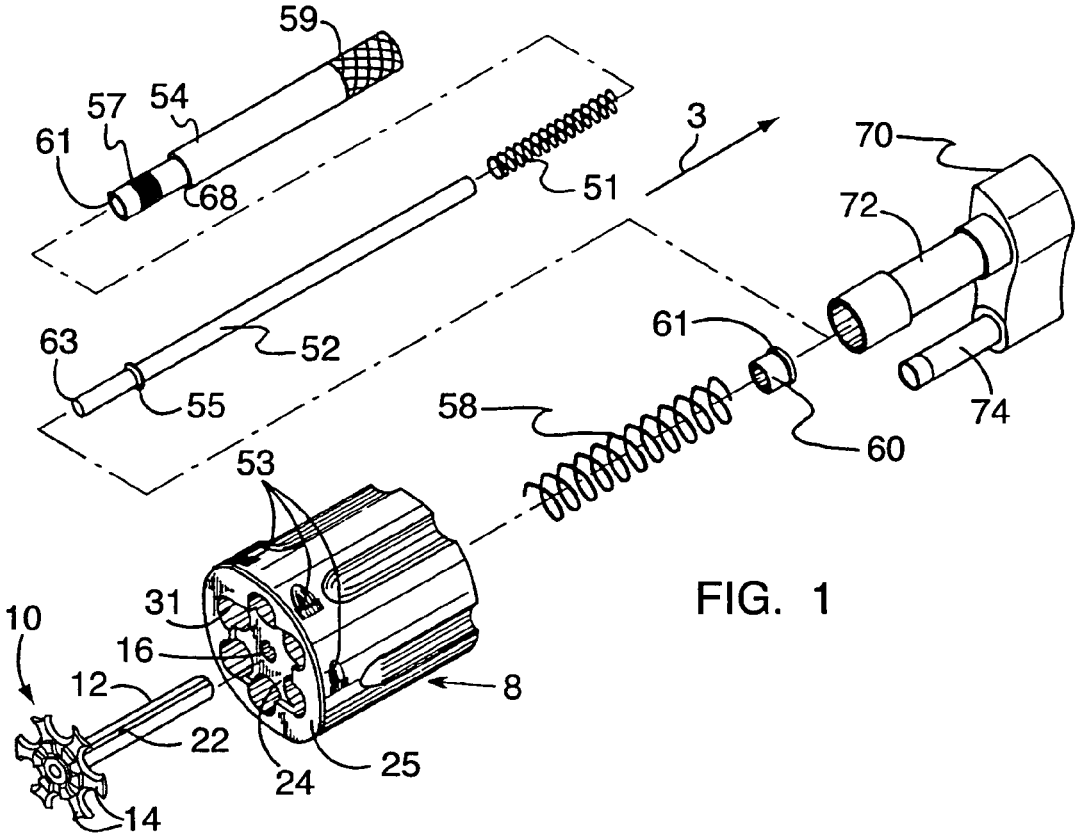
FIG. 1 is an exploded perspective view of an extractor and associate components used in the cylinder of a revolver of the type embodying this invention.
Figure 2:
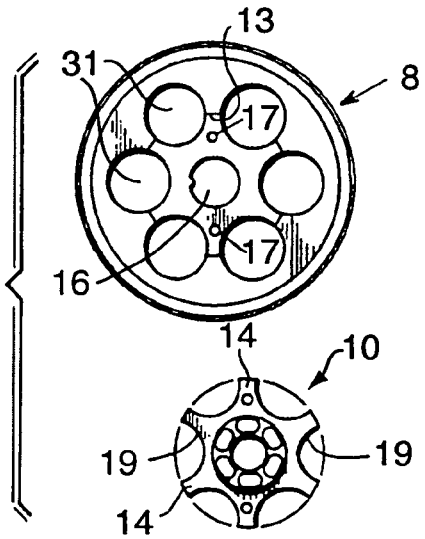
FIG. 2 Prior Art
FIGS. 2 and 3 are elevational views of prior art cylinders and extractors commonly used in revolvers.
Figure 3:
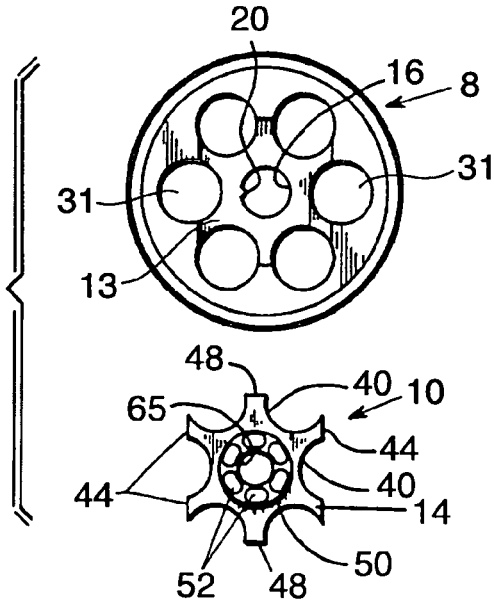
FIG. 3 Prior Art

Referring to FIG. 1, an exemplary cylinder assembly includes a cylinder 8 having its forward end toward the right, as indicated by an arrow 3, may be fitted with an extractor plate 10 of the type embodying this invention. Prior art extractor designs for such cylinder assemblies include extractor plates that fit within the recess 13 of cylinder 8 are shown in FIGS. 2 and 3. Similar to the present invention, prior art extractors have an extractor plate 10 disposed adjacent the rear end of a tubular stem 12 and includes a plurality of radially extending arms 14. The stem 12 is slidably disposed within a stem bore 16 that extends axially through the cylinder 8. The stem bore 16 includes a projection or lug 20 adapted to interfit with a longitudinally extending groove 22 in the stem 12 to limit movement of the stem in the cylinder 8 to the longitudinal or axial direction.

As mentioned above, in prior art extractors the after-end of the cylinder 8 includes a shallow recess 13 adapted to receive therein the extractor plate 10 such that the upper surface of the extractor plate, including its arms 14, will be generally flush with the peripheral rear surface 25 of cylinder 8 about the recess 13. Because it is not feasible to hold close enough tolerances between the lug 20 and the elongated slot 22, additional mechanisms must be provided to align such extractor plates with the chambers of the cylinder.

Figure 6:
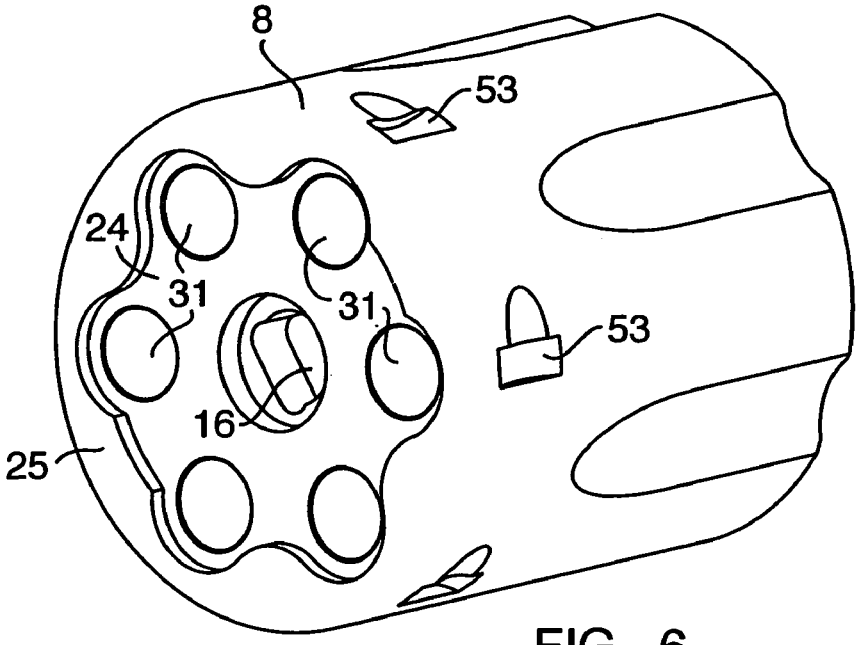
FIG. 6 is a perspective view of the cylinder used with the present invention.
Figure 7:
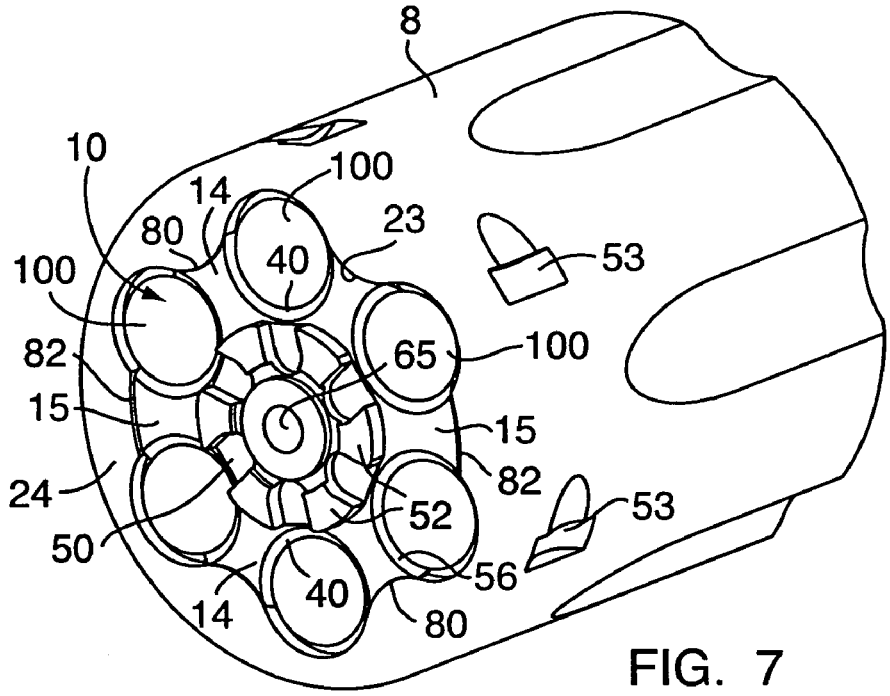
FIG. 7 is a perspective view of an embodiment of an extractor and cylinder of the present invention.
Figure 8:
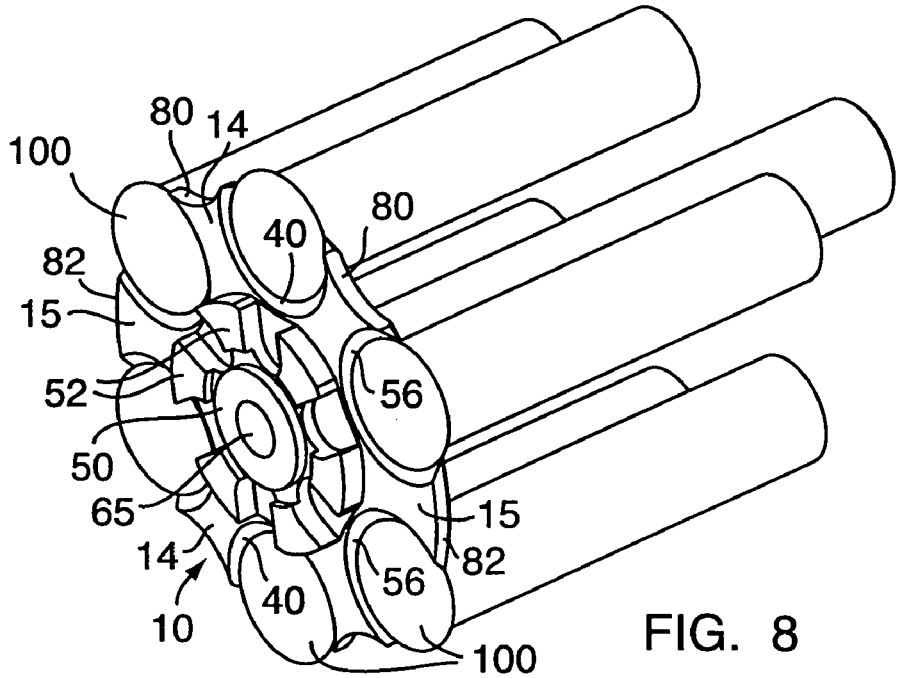
FIG. 8 is a perspective detail view of a portion of the cylinder assembly of the present invention.

As shown in FIG. 2, prior art extractors employ lugs or pins 17 to ensure circumferential alignment of the cylindrically curved surfaces 19 and 40 (FIGS. 2 and 3 respectively) of the arms with the cartridge receiving chambers 31, also referred to as bores or cylinder bores, of the cylinder 8 (See FIG. 6) so that the curved edge surfaces 19 and 40, will fit under the corresponding rim portions of cartridges 100 (See FIGS. 7, and 8). A more recent prior art arrangement utilizes arms having radially asymmetrical rectilinear or straight outer edges 44 and 48, as shown in FIG. 3, to ensure circumferential alignment. This arrangement eliminates the need for lugs or pins as present in the extractor shown in FIG. 2. In both prior art arrangements however, the arc length of the curved surfaces of the arms 19 and 40 (FIGS. 2 and 3 respectively) is less than half the circumference of the cartridge.

Figure 4A:
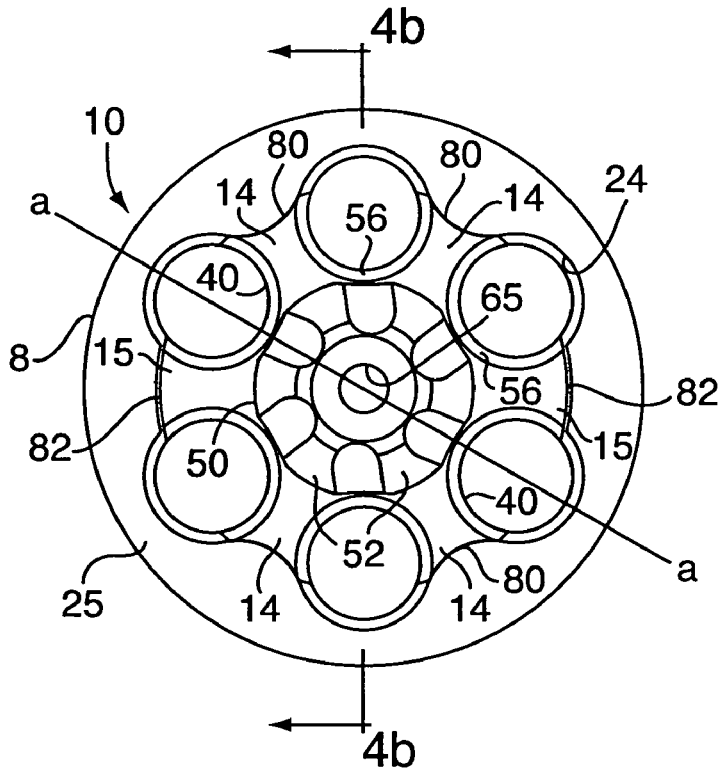
FIGS. 4*a* and 4*b* are cross-sectional and elevational views respectively of an embodiment of the extractor of the present invention.
Figure 4B:
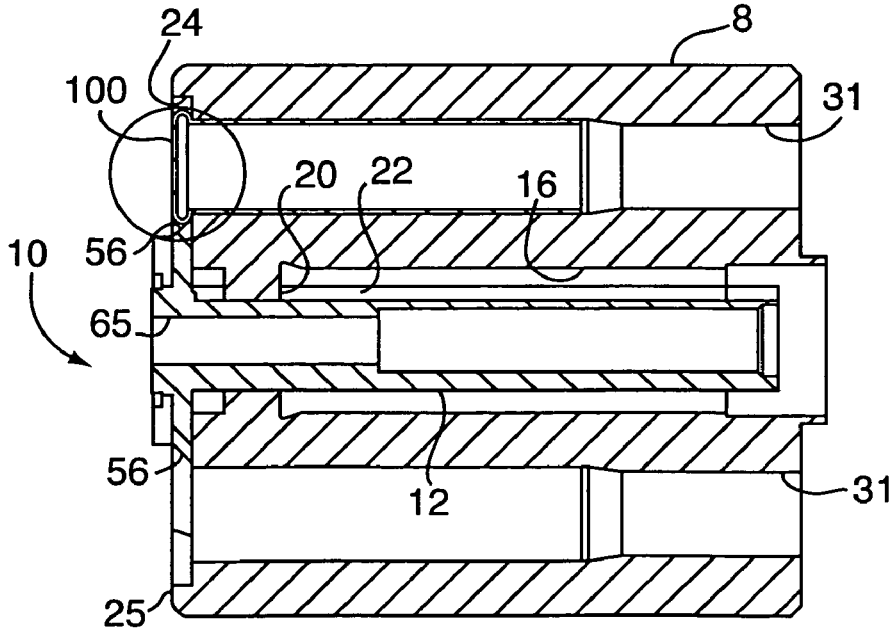
Figure 4C:
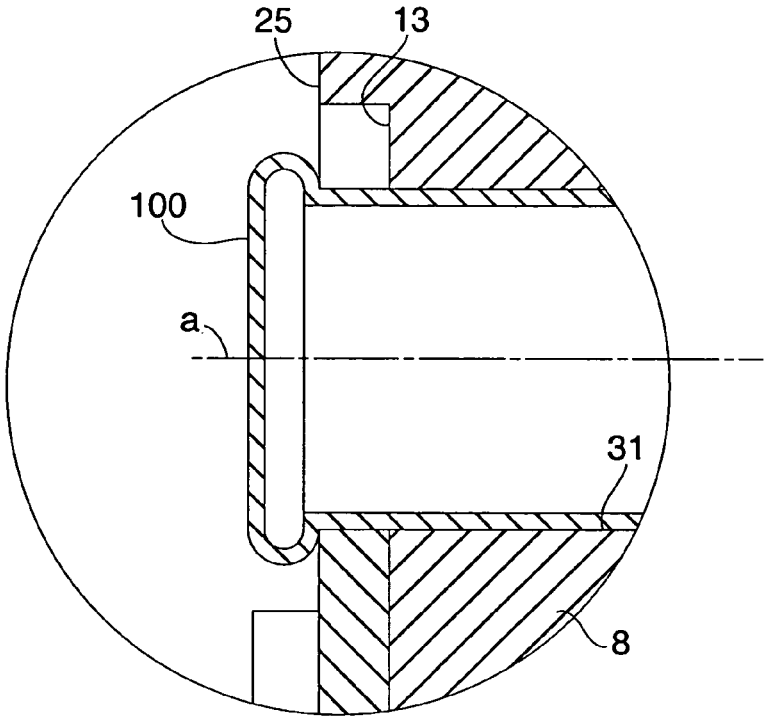
FIG. 4c Prior Art
FIG. 4*c* is a detail cross section of a portion of a cylinder assembly of the prior art.
Figure 4D:
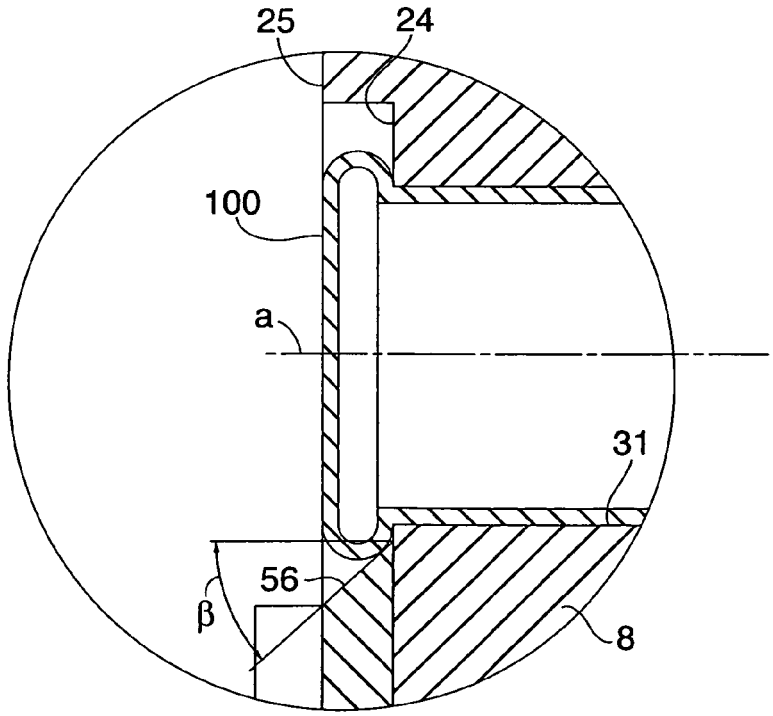
FIG. 4*d* is a detail cross section of a portion of a cylinder assembly including an embodiment of the present invention.
Figure 5:
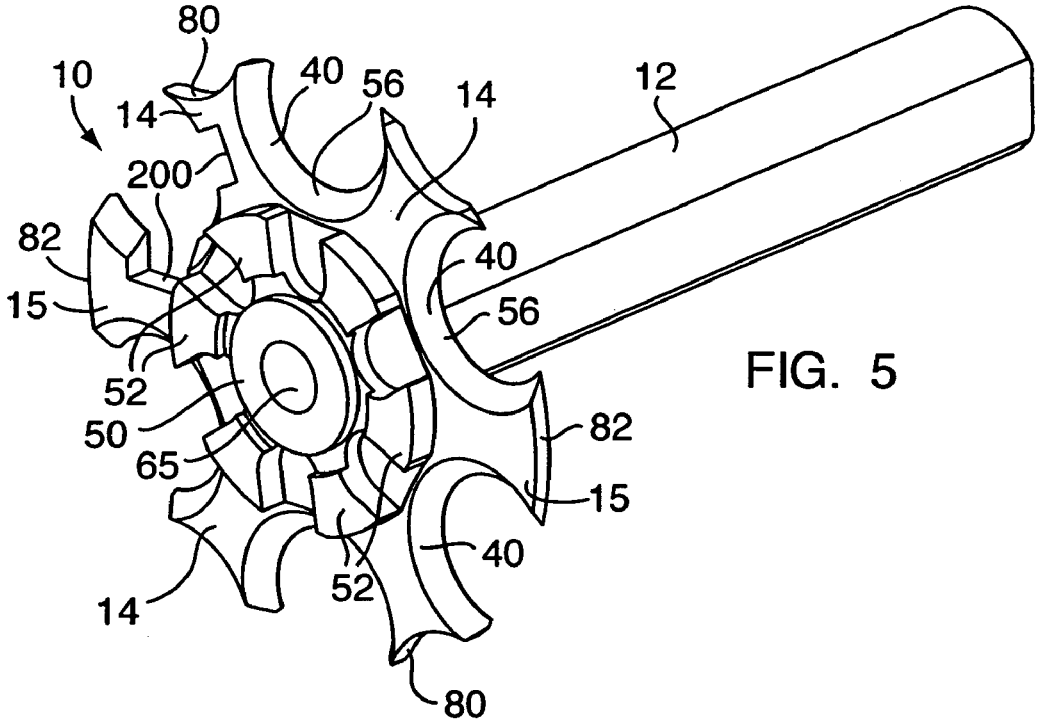
FIG. 5 is a perspective view of the extractor of the present invention.

In the present invention, shown in FIGS. 4*a*, 4*b*, 4*d*, 5, 7, 8 and 9, the extractor plate 10 includes a plurality of arms 14, 15 that extend radially from the inner or hub portion of the plate secured to the stem 12. Each arm 14 and 15 has radiused or curved side edges which combine to form an inner surface 40 between adjacent arms (FIG. 5). The inner surface substantially conforms to the shape of the cartridge receiving chambers. The inner portion may be a continuous curved concave surface or may be discontinuous concave surface with cut-away portions or teeth 200 (See FIG. 5). In either case, the arc length of the inner surface 40 exceeds half the circumference of a cartridge 100 disposed within the cartridge receiving chambers thereby increasing the area of engagement of the extractor under the rim of the cartridge 100.

Referring to FIGS. 4*a* and 5, each arm 14 includes a radially extending longitudinal axis a and is defined by radiused side edges which form a concave inner surface 40. In a preferred embodiment, two of the arms 15 have convex outer edges or end portions 82, the remainder of the arms 14 have concavely curved outer edges or end portions 80.

Additionally, as shown in FIGS. 4*b* and 4*d*, the cartridge receiving chambers 31 of the present invention are entirely disposed within the cylinder 8. Additionally, the concave inner surface 40 of the extractor 10 features beveled edges 56 (FIG. 4*d*). The edges 56 are beveled at an angle β relative to a central axis a of a cylinder bore. Only the edge contacts the rim of the cartridge and does not form a portion of the wall of a cartridge receiving chamber. Because in the present invention the extractor does not form any part of the wall, a rim fire case can expand outwardly without affecting the extractor, thereby providing for substantially easier removal of the spent rim fire cartridges. In the preferred embodiment, β is approximately 60 degrees.

Although in the preferred embodiment β is 60 degrees, other angles may be selected as well. Moreover, in an alternative embodiment edge need not be rectilinear or straight as shown in cross section but may have a curved profile (not shown).

As shown in FIGS. 4*a* and 4*b*, the extractor 10 also includes, on its rear surface, an upstanding ring or annulus 50 on which are formed a plurality of ratchet projections or lugs 52. Each such ratchet 52 is disposed in radial alignment with one of the arms 14, 16 of the extractor. A mechanical "hand" (not shown) is located to engage on the ratchets 52 sequentially to rotate the cylinder incrementally as the trigger of the revolver is moved to fire each round carried in the several chambers of the cylinder 8. With each increment of rotation of cylinder 8, one of the recesses or cutouts 53 (See FIG. 1) in the outer peripheral surface of the cylinder 8 adjacent its rear surface 25, will be released by a locking member (not shown) disposed to alternately engage and release each of the recesses 53 to enable indexing movement of the cylinder 8 in response to movement of the trigger as has been more fully shown and described in U.S. Pat. No. 4,641,449.

Referring again to FIG. 1, disposed within the stem 12 of the extractor is a center pin 52 about which the cylinder 8 is rotatable. A center pin spring 51 is fitted about the forward end portion of the pin 52 and the inner or rear end of the spring 51 is seated against a flange 55 on the pin 52. The rear end of the pin 52 and the spring 51 are fitted into the bore of the stem 12 and an extractor spring 58 and a collar 60 adapted to fit within the forward end of spring 58 fitted about the outer diameter of the stem 12 and disposed within the bore 16 of the cylinder 8. The flange 55 on pin 50 is engaged with a shoulder within the stem 12 adjacent its rear end. The forward end portion of the center pin 52 and spring 51 are received into the open end of the extractor rod 54 and the rear end 61 of the extractor rod 54. The rear end portion of the rod 54 is threaded, as at 57, for screw fitting into the internally threaded forward end portion of the stem 12 to complete the assembly. Further, the rod 54 being of stepped outer diameter includes a shoulder 68 which serves as a seat for a rim or flange 67 of the collar 60 disposed within the forward end of the extractor spring 58. The outer end of the spring 58 is seated against the forward surface of the extractor plate 10.

Spring 51 releasably urges the pin 52 rearwardly, or to the left, as depicted in FIG. 1. The rear end of the pin, as at 63, extends outwardly of the center hole 65 (FIG. 7) of the extractor plate 10 and serves as a locking mechanism in a detent for holding the cylinder 8 in the window of the frame and in alignment with the barrel of the revolver and is releasable by a thumb piece assembly, as is well known in the art and is shown and described in U.S. Pat. No. 4,934,081. Referring again to FIG. 1, the forward end of the extractor rod, knurled as at 59, to facilitate grasping and manipulating the rod 54 to operate the extractor, extends through a tubular arbor portion 72 of yoke 70. The yoke 70 includes a stud portion 74 adapted to fit for pivotal movement into a cylindrical bore of a revolver frame (not shown) for pivotable movement of the cylinder 8 into and out of the window of the revolver frame, as shown and described in U.S. Pat. Nos. 1,181,417 and 4,934,081. The forward end of the extractor rod 54 is adapted to be releasably engaged by a spring loaded plunger within a bolt housing (not shown) disposed on a lower portion of the barrel, as shown and described in U.S. Pat. No. 4,934,081.

After the cylinder 8 is swung out of the frame window, the shooter may grasp the knurled end of the rod 54 and move the rod and stem 12 connected thereto. The extractor plate 10 will thereby eject the cartridge cases from the chambers of the cylinder 8. As the rod 54 is moved rearward in this manner, extractor spring 58 will be compressed and when released, the spring 58 will return the extractor rod 54 and the extractor 10 to its forward position in recess 24. At the same time, the radial arms 14 of the extractor plate 10 will automatically be repositioned in angular alignment with the cartridge receiving chambers 31 of the cylinder 8 because of the rectilinear configuration of the arms 14 and the corresponding upright edge portions of the recess 24. Significantly, moreover, this advantageous result is achieved without the necessity of using extractor pins and holes to receive the pins as in the prior art extractors.

The foregoing description is intended to describe the preferred form of the invention and the best mode contemplated by me for carrying out this invention. To those skilled in the art, however, various modifications and variations to the specific embodiments described herein may be apparent without departing from the scope of my invention.

What is claimed as:

1. An extractor for the removal of cartridges from the cylinder bores of a revolver, said extractor comprising:

an extractor plate having a plurality of arms extending radially outward from an inner portion of the plate, said arms forming an inner surface between adjacent arms, said inner surface substantially conforming to the profile of a bore of the cylinder; said inner surface having an arc length that is greater than one-half the circumference of a cartridge disposed within a cylinder bore of the revolver, said inner surface contacts a rim of the cartridge and facilitates the removal of the cartridge from the bore;

a tubular stem having an end that is mounted to said inner portion of the extractor plate; and wherein the inner surface between adjacent arms is a substantially non-continuous concave surface.

2. An extractor for the removal of cartridges from cylinder bores of a revolver, said extractor comprising:

an extractor plate having a plurality of arms extending radially outward from an inner portion of the plate, said arms forming an inner surface between adjacent arms, said inner surface substantially conforming to the profile of a bore of the cylinder; said inner surface having an arc length that is greater than one-half the circumference of a cartridge disposed within a cylinder bore of the revolver, said inner surface contacts the rim of a cartridge and facilitates the removal of the cartridge from the bore;

a tubular stem having an end that is mounted to said inner portion of the extractor plate; and wherein the inner surface between adjacent arms has a beveled edge which is at an angle β relative to a central axis of the cylinder of the revolver, said beveled edge contacts the cartridge at its rim such that the extractor plate does not form a portion of a cylinder bore.

3. The extractor of claim 2 wherein angle β is about 60 degrees relative to the central axis of a cylinder of the revolver.

4. An extractor for the removal of cartridges from cylinder bores of a revolver, said extractor comprising:

an extractor plate having a plurality of arms extending radially outward from an inner portion of the plate, said arms forming an inner surface between adjacent arms, said inner surface substantially conforming to the profile of a bore of a cylinder; said inner surface having an arc length that is greater than one-half the circumference of a cartridge disposed within a cylinder bore of the revolver, said inner surface contacts the rim of a cartridge and facilitates the removal of the cartridge from the bore;

a tubular stem having an end that is mounted to said inner portion of the extractor plate;

wherein the arms include an end portion that abuttingly contacts an inner surface of the cylinder to align the concave inner surfaces of the extractor plate with the bores of the cylinder; and wherein the end portion of the arms is a concave surface.

5. An extractor for the removal of cartridges from a cylinder of a revolver, said extractor comprising:

an extractor plate having a plurality of arms extending radially outward from an inner portion of the plate, said arms forming an inner surface between adjacent arms, said inner surface contacts a rim of a cartridge and facilitates the removal of the cartridge from bore of the cylinder of a revolver, the inner surface having a beveled edge, said beveled edge being spaced apart from said bore when the edge is engaged with the cartridge rim and the cartridge is within said bore in a position in which the cartridge may be discharged, said arms further including an end portion that abuttingly contacts an inner surface of the cylinder to align concave inner surfaces of the extractor plate with the bores of the cylinder; and a tubular stem having an end that is mounted to said inner portion of the extractor plate.

6. The extractor of claim 5 wherein said beveled edge is at an angle of about 60 degrees relative to a central axis of the cylinder of the revolver.

7. A firearm having a cylinder, said firearm comprising:

an extractor plate having a plurality of arms extending radially outward from an inner portion of the plate, said arms forming an inner surface between adjacent arms, said inner surface substantially conforming to the profile of a bore of the cylinder, said inner surface having an arc length that is greater than one-half the circumference of a cartridge disposed within a cylinder bore of the firearm, said inner surface contacts a rim of the cartridge and facilitates the removal of the cartridge from the cylinder bore, said inner surface being spaced apart from said cylinder bore when the inner surface is engaged with the cartridge rim and the cartridge is within said cylinder bore in a position in which the cartridge may be discharged; and a tubular stem having an end that is mounted to said inner portion of the extractor plate.

8. The firearm of claim 7 wherein the inner surface between adjacent arms is a substantially continuous curved concave surface.

9. A firearm having a cylinder, said firearm comprising:

an extractor plate having a plurality of arms extending radially outward from an inner portion of the plate, said arms forming an inner surface between adjacent arms, said inner surface substantially conforming to the profile of a bore of the cylinder, said inner surface having an arc length that is greater than one-half the circumference of a cartridge disposed within the cylinder bores of the revolver, said inner surface contacts the rim of a cartridge and facilitates the removal of the cartridge from the bore;

a tubular stem having an end that is mounted to said inner portion of the extractor plate; and wherein the inner surface between adjacent arms is a substantially discontinuous concave surface.

10. A firearm having a cylinder, said firearm comprising:

an extractor plate having a plurality of arms extending radially outward from an inner portion of the plate, said arms forming an inner surface between adjacent arms, said inner surface substantially conforming to the profile of a bore of the cylinder, said inner surface having an arc length that is greater than one-half the circumference of a cartridge disposed within the cylinder bores of the firearm, said inner surface contacts the rim of a cartridge and facilitates the removal of the cartridge from the bore;

a tubular stem having an end that is mounted to said inner portion of the extractor plate; and wherein the inner surface between adjacent arms has a beveled edge which is at an angle β relative to a central axis of the cylinder of the firearm, said beveled edge contacts the cartridge at its rim such that the extractor plate does not form part of the bores of the cylinder.

11. The firearm of claim 10 wherein angle β is about 60 degrees relative to the central axis of the cylinder of the firearm.

12. A firearm having a cylinder, said firearm comprising:

an extractor plate having a plurality of arms extending radially outward from an inner portion of the plate, said arms forming an inner surface between adjacent arms, said inner surface substantially conforming to the profile of a bore of the cylinder, said inner surface having an arc length that is greater than one-half the circumference of a cartridge disposed within the cylinder bores of the revolver, said inner surface contacts the rim of a cartridge and facilitates the removal of the cartridge from the bore;

a tubular stem having an end that is mounted to said inner portion of the extractor plate; and wherein each arm includes an end portion that abuttingly contacts an inner surface of the cylinder to align the inner surfaces of the extractor plate with the bores of the cylinder.

13. The firearm of claim 12 wherein the end portions of the arms have a concave surface.

14. A firearm having a cylinder, said firearm comprising:

an extractor plate having a plurality of arms extending radially outward from an inner portion of the plate, each arm including an end portion that abuttingly contacts an inner surface of the cylinder to align the inner surfaces of the extractor plate with the bores of the cylinder;

said arms forming an inner surface between adjacent arms, said inner surface substantially conforming to the profile of a bore of the cylinder, said inner surface having an arc length that is greater than one-half the circumference of a cartridge disposed within the cylinder bores of the revolver, said inner surface contacts the rim of a cartridge and facilitates the removal of the cartridge from the bore, said inner surface having a beveled edge which is at an approximately 60 degree angle relative to a central axis of the cylinder of the revolver, said beveled edge contacts the cartridge at its rim such that the extractor plate does not form a portion of the bores of the cylinder;

a tubular stem having an end that is mounted to said inner portion of the extractor plate; and wherein the inner surface between adjacent arms is a substantially continuous curved concave surface.

15. A firearm having a cylinder, said firearm comprising:

an extractor plate having a plurality of arms extending radially outward from an inner portion of the plate, each arm including an end portion that abuttingly contacts an inner surface of the cylinder to align the inner surfaces of the extractor plate with the bores of the cylinder;

said arms forming an inner surface between adjacent arms, said inner surface substantially conforming to the profile of a bore of the cylinder, said inner surface having an arc length that is greater than one-half the circumference of a cartridge disposed within the cylinder bores of the revolver, said inner surface contacts the rim of a cartridge and facilitates the removal of the cartridge from the bore, said inner surface having a beveled edge which is at an approximately 60 degree angle relative to a central axis of the cylinder of the revolver, said beveled edge contacts the cartridge at its rim such that the extractor plate does not form a portion of the bores of the cylinder; and wherein the inner surface between adjacent arms is a substantially discontinuous concave surface.

16. An extractor for the removal of cartridges from cylinder bores of a revolver, said extractor comprising:

an extractor plate having a plurality of arms extending radially outward from an inner portion of the plate, said arms forming an inner surface between adjacent arms, said inner surface substantially conforming to the profile of a bore of a cylinder; said inner surface having an arc length that is greater than one-half the circumference of a cartridge disposed within a cylinder bore of the revolver, said inner surface contacts the rim of a cartridge and facilitates the removal of the cartridge from the bore, at least one of said arms having a convex end portion that abuttingly contacts an inner surface of the cylinder to align the inner surfaces of the extractor plate with the bores of the cylinder;

a tubular stem having an end that is mounted to said inner portion of the extractor plate; and wherein the inner surface between adjacent arms has a beveled edge which is at an angle β relative to a central axis of the cylinder of the revolver, said beveled edge contacts the cartridge at its rim such that the extractor plate does not form a portion of the cylinder bores.

* * * * *